US005138850A

United States Patent [19]

Müller et al.

[11] Patent Number: 5,138,850

[45] Date of Patent: Aug. 18, 1992

[54] SPRING BIASED PATTERN BARS HAVING ELECTROMAGNETIC SELECTORS

[75] Inventors: Gerhard Müller, Esslingen; Werner Engelfried, Sindelfingen, both of Fed. Rep. of Germany

[73] Assignee: Terrot Strickmaschinen GmbH, Stuttgart, Fed. Rep. of Germany

[21] Appl. No.: 743,981

[22] Filed: Aug. 12, 1991

[30] Foreign Application Priority Data

Aug. 30, 1990 [DE] Fed. Rep. of Germany ..... 4027379

[51] Int. Cl.[5] ..... D04B 15/78

[52] U.S. Cl. ..... 66/221; 66/223; 66/230

[58] Field of Search ..... 66/220, 221, 223, 224, 66/230

[56] References Cited

U.S. PATENT DOCUMENTS

| | | | |
|---|---|---|---|
| 3,638,456 | 2/1972 | Güell | 66/223 |
| 3,791,174 | 2/1974 | Güell | 66/223 |
| 3,945,223 | 3/1976 | Philip | 66/223 |
| 4,068,497 | 1/1978 | Haynie | 66/230 |
| 4,147,042 | 4/1979 | Bourgeois | 66/230 X |
| 4,538,431 | 9/1985 | Lonati | 66/224 |
| 5,042,275 | 9/1991 | Schick | 66/223 |

*Primary Examiner*—Werner H. Schroeder
*Assistant Examiner*—John J. Calvert
*Attorney, Agent, or Firm*—Shenier & O'Connor

[57] ABSTRACT

A circular knitting machine having knitting needles actuated by pattern bars, electromagnetic selectors for adjusting the knitting needles into various operating positions, mechanical controls cooperating with the electromagnetic selectors, selector elements biased by springs and slidingly displaceable in the pattern bars as well as first and second control cams for pivoting the pattern bars. Only one single, spring-biased selector element is mounted for displacement in each pattern bar. The electromagnetic selectors have individually controllable magnetic poles which are arranged one behind the other in the direction of rotation of the needle cylinder.

1 Claim, 2 Drawing Sheets

SPRING BIASED PATTERN BARS HAVING ELECTROMAGNETIC SELECTORS

BACKGROUND OF THE INVENTION

The invention relates to a knitting machine according to the preamble to the patent claim.

A knitting machine of this type is known from DE-OS 37 01 743. In the known knitting machine, the selector elements in the associated pattern bars are displaceable only in a one-sided sliding guide means which can lead to jamming of the selector elements and therefore to faults in the knitting pattern. Moreover, in this case two superposed magnet arrangements are required for each pattern bar and so the height of the knitting machine requires an excessive amount of space. Finally, the known knitting machine requires two selector elements in each pattern bar which makes manufacture more complicated and increases susceptibility to breakdowns in an undesired manner.

OBJECT OF THE INVENTION

The object of the invention is to remedy the described faults of the known knitting machine and improve this knitting machine such that the selector elements are reliably guided in their pattern bars, the knitting machine in its overall height requires less space and the selector elements can be produced in a simple manner and are less susceptible to breakdowns.

The object is accomplished in accordance with the invention by the characterizing features of the patent claim.

The following description of a preferred embodiment of the invention serves to explain the invention in greater detail in conjunction with the attached drawings, in which:

DETAILED DESCRIPTION OF THE PREFERRED EMBODIMENTS

Figure 1:
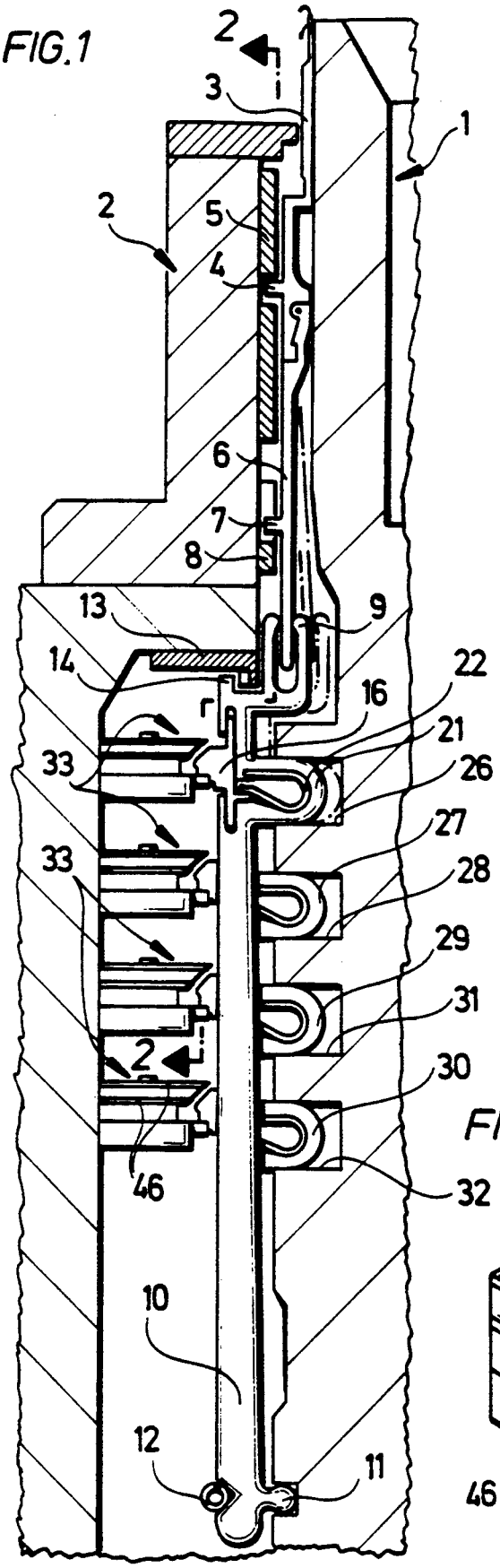
FIG. 1 shows schematically an axial, part-sectional view of a circular knitting machine.

The knitting machine illustrated schematically and only partially in FIG. 1 comprises in the customary manner a rotatably mounted needle cylinder 1 which is surrounded by a stationary cam ring 2 consisting of several parts. Knitting needles 3 are mounted in the customary manner for axial sliding displacement on the outer side of the needle cylinder 1 in longitudinal slots arranged next to one another. Each knitting needle 3 comprises a control butt 4 interacting with a cam part 5 to bring about the downward movement of the knitting needle (cf. also FIG. 2). Each knitting needle 3 is connected at its lower end in the conventional manner with a pusher means 6 comprising a control butt 7. This control butt interacts with a cam part 8 which triggers the upwardly oriented, drive-out movement of the pusher means 6 and the knitting needle 3 connected therewith (cf. FIG. 2). The lower end of the pusher means 6 is accommodated for axial sliding displacement in a fork-like claw 9 of a pattern bar 10 which is pivotally mounted at its lower end by means of a projection 11 in a groove of the needle cylinder 1 and, together with additional pattern bars arranged adjacent thereto, is held on the needle cylinder 1 by a helical spring peripherally surrounding this cylinder. When the pattern bar 10 is pivoted to the right in the clockwise direction about the projection 11 acting as pivot point, out of the position illustrated in FIG. 1 by solid lines and into the position illustrated by dash-dot lines, the pusher means 6 is taken along so that its control butt 7 is disengaged from the cam part 8 and, therefore, the upward movement of pusher means 6 and knitting needle 3 is prevented or interrupted. The knitting needle 3 therefore remains in a specific position in relation to the needle cylinder 1 and is then later returned to the initial position again by the cam part 5 engaging on the control butt 4. In this way, any desired knitting patterns (multicoloured patterns or knitting combinations) can be produced in a manner known per se by correspondingly controlling the pattern bars 10.

An eccentric return means 13 rigidly connected to the cam ring 2 cooperates with a control foot 14 on the pattern bar 10 and guides the pattern bar 10, in a manner known per se, back into the initial position illustrated in FIG. 1 by solid lines.

Figure 4:
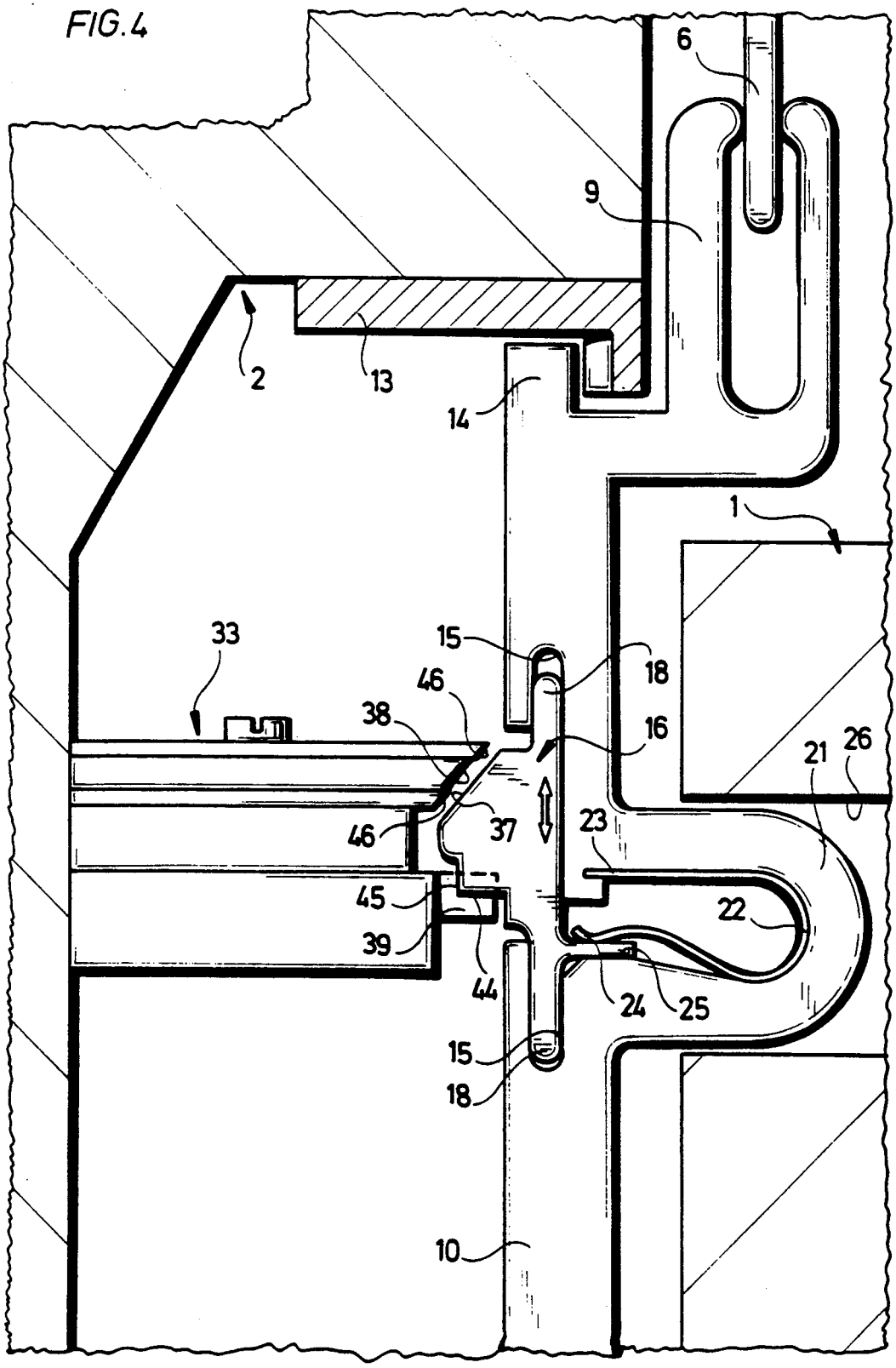
FIG. 4 is a part-sectional view on an enlarged scale in comparison with FIG. 1 of a pattern bar controlled by the magnetic selector means.

As best seen from the enlarged view in FIG. 4, a selector element 16 is mounted in superposed slots 15 in the pattern bar 10 for sliding displacement in the longitudinal direction of the pattern bar 10. For this purpose, the selector element 16 engages in the slots 15 of the pattern bar 10 with two arms 18 axially projecting from it in opposite directions. This ensures a sliding guidance of the selector element 16 without jamming.

The pattern bar 10 comprises in the region of the selector element 16 a bulge 21 directed towards the axis of rotation of the needle cylinder 1. A U-shaped spring 22 having two free arms 23, 24 is arranged in this bulge and is designed such that, normally, the free ends of the arms 23, 24 are biased apart from one another. The free end of the arm 23 is firmly inserted into a notch in the pattern bar 10. The free end of the arm 24 presses on a projection 25 of the selector element 16 and thereby holds the latter in its lower end position illustrated in FIG. 4. The bulge 21 of the pattern bar 10 which accommodates the spring 22 is, itself, accommodated by a corresponding groove 26 in the needle cylinder 1 so as to be freely movable in a radial direction. Instead of a U-shaped spring 22, other springs which act in the same manner, e.g. bar, torsion or helical springs and the like, could be used.

In the case of the next pattern bar, which is arranged in FIG. 1 behind the illustrated pattern bar 10, the bulge 27 corresponding to the bulge 21 is located at a lower level and extends into a groove 28 of the needle cylinder 1 arranged below the groove 26. The bulge 27 again accommodates a U-shaped spring 22 which cooperates with a selector element 16 of the next pattern bar located in FIG. 1 below the visible bar 10.

As shown in FIG. 1, four pattern bars 10 arranged one behind the other comprise bulges 21, 27, 29 and 30, respectively, which are arranged in corresponding grooves 26, 28, 31 and 32, respectively, of the needle cylinder 1 and accommodate U-shaped springs 22 cooperating with associated selector elements 16.

Electromagnetic selector means 33, the mode of operation of which will be explained further on, cooperate with each selector element 16 in a respective pattern bar 10. As illustrated in FIG. 1, each of the four pattern bars 10 arranged one behind the other is associated with one electro-magnetic selector means 33 which is secured in the cam ring 2 of the knitting machine at the level of the respective bulge 21, 27, 29 or 30. Due to the superposed arrangement, as described above, of a plurality of electromagnetic selector means 33 per knitting point, longer functioning times of the magnets are obtained by alternating switching of these selector means which results in a more precise control of the individual pattern bars 10.

Figure 2:
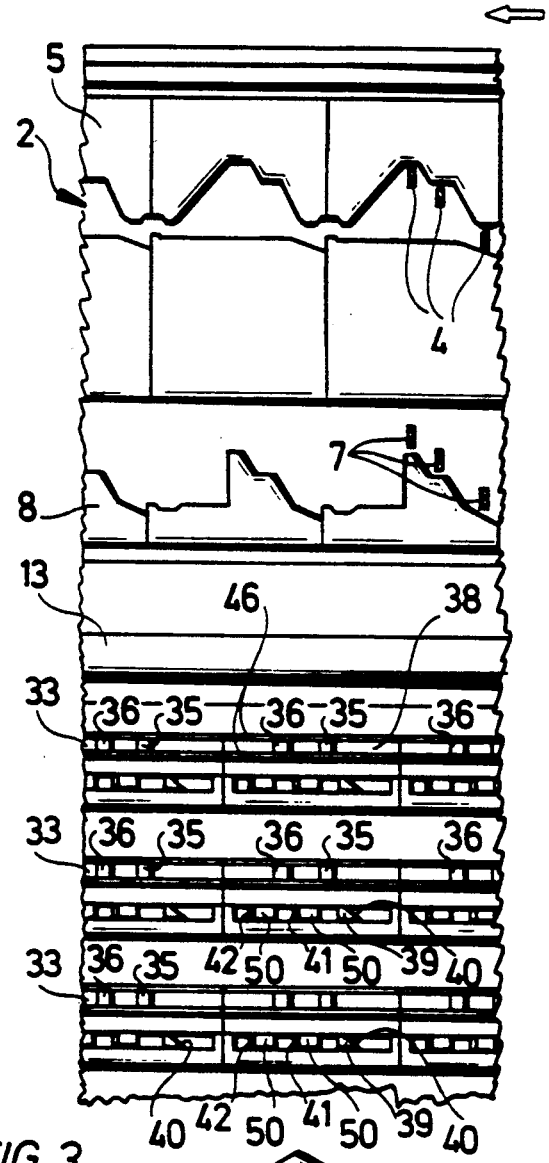
FIG. 2 is a schematic view of cam parts, magnetic selector means and control elements of the knitting machine from FIG. 1.

The electromagnetic selector means 33 — cf., in particular, FIG. 4 — are individually controlled in a known manner via control lines (which are not illustrated). The electromagnetic selector means 33 each comprise for each pattern bar 10 and each knitting point two magnetic poles 35, 36 which are arranged at the same level one behind the other in the direction of rotation of the needle cylinder 1 and are controllable individually or together and can act directly on the associated selector elements 16. In FIG. 2, these magnetic poles 35, 36 are schematically illustrated as single poles. They can also be advantageously designed as double poles arranged vertically one above the other, i.e. each consist of north and south poles. In a preferred embodiment of the invention (which is not illustrated), each of the magnetic selector means 33 consists in a manner known per se of a permanent magnet which engages directly on the selector element 16 and with which electromagnets, which can be switched selectively on and off, are associated. The geometrical arrangement of the permanent magnets and electromagnets is such that each electromagnet can attenuate and possibly also amplify the effect of the permanent magnet associated with it. In other embodiments of the invention, the electromagnetic selector means may also be of a different design, in a manner known per se.

In the embodiment according to FIG. 4, the selector element 16 displaceable in the pattern bar 10 comprises a surface 37 which is inclined relative to its axial direction of displacement and can cooperate with a correspondingly inclined surface 38 of the electromagnetic selector means 33 and their magnetic poles 35, 36. In FIG. 4, the magnetic poles 35, 36 are assumed to be inoperative. Consequently, the selector element 16 is displaced downwardly due to the action of the U-shaped spring 22 and securely held in this position.

Figure 3:
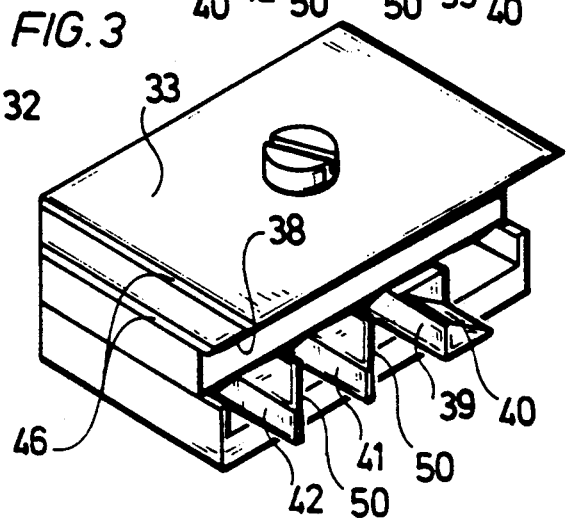
FIG. 3 is a diagrammatic view of eccentric control means and control cams from FIG. 2

An eccentric control means 39, a first control cam 41 as well as a second control cam 42, the design and arrangement of which are best seen from FIG. 3, cooperate with each of the selector elements 16 in each pattern bar 10 which effect control of the pattern. The eccentric control means 39 has the shape of a prism having a triangular cross section. Each selector element 16 has an edge or surface 44 which extends at right angles to its direction of displacement and cooperates with an upper inclined face 40 of the prismatic eccentric control means 39 during rotation of the needle cylinder 1 relative to the cam ring 2 such that the eccentric control means 39 displaces the selector element 16 upwards out of the position illustrated in FIG. 4, contrary to the action of the spring 22, and into engagement with the electromagnetic selector means 33 where the selector element 16 is held by corresponding activation of the magnetic poles 35, 36. This other end position of the selector element 16 corresponds to the knitting position of the knitting needles 3, i.e. in this position of the selector element 16 the pattern bar 10 will not pivot. The control butt 7 of the pusher means 6 remains in contact with the cam part 8 so that the relevant knitting needle 3 is driven out to its full extent.

If, for example, the first magnetic pole 35 is now controlled at the right point in time such that an attenuated or no magnetic effect is present at the inclined surface 38 of this pole 35, the arm 24 of the U-shaped spring 22 draws the selector element 16 downwards so that an edge or surface 45 provided thereon, which extends parallel to the direction of movement of the selector element 16 and at right angles to the edge or surface 44, comes into contact with a laterally inclined surface 50 of the control cam 41 which hereby displaces the selector element 16 (to the right in FIGS. 1 and 4). This causes the pattern bar 10 connected with the selector element to pivot so that the control butt 7 of the pusher means 6 is disengaged from the cam part 8. This prevents the knitting needle 3 from being driven out and the needle remains in the floating position.

When, in contrast to the control procedure described in the above, the second magnetic pole 36 is attenuated or made inoperative by corresponding electrical control, the arm 24 of the U-shaped spring 22 displaces the selector element 16 downwards at a later point in time so that its edge or surface 45 comes into contact with the second control cam 42. This control cam 42 then interrupts (at a later point in time than the control cam 41) the drive-out movement of the knitting needle 3 so that it now remains in the tucking position. (In FIG. 2, approximately in the middle, the three possible operating positions of the knitting needle 3, namely the floating, tucking and knitting positions, are indicated from right to left on the basis of the control butts 7).

With the arrangement as described, a rapid and precise response of the selector elements 16 and, therefore, the pattern bars 10 can be achieved each time by corresponding control of the electromagnetic selector means 33 in cooperation with the U-shaped spring 22. In particular, the spring 22 is advantageous because it enables rapid release of the selector elements from the magnets. In addition, it is favourable to have a plurality of electromagnetic selector means 33 arranged one beneath the other, as already mentioned, these means each cooperating with selector elements 16 and pattern bars 10 which are peripherally offset accordingly.

As best seen in FIGS. 3 and 4, strips 46 made of wear-resistant material, for example glass, ceramics or plastic, are provided on the inclined surfaces 38 of the magnetic selector means 33. These strips protrude somewhat beyond the the surface 38 with their front, inclined edges. The selector elements 16 slide along these strips 46 with their inclined surfaces 37 when they are attracted by a permanent magnet with the magnetic poles 35, 36 and the needle cylinder 1 rotates relative to the cam ring 2.

In the embodiment as described (cf., in particular, FIG. 4), the inclined faces 37, 38 provided on the selector elements 16 and the electromagnetic selector means 33, respectively, result in a larger, magnetically effective contact region in comparison with surfaces extending parallel to the direction of movement of the selector elements 16. An additional advantage of these inclined surfaces 37, 38 over surfaces extending parallel to the direction of movement of the selector elements 16 is the fact that hereby a slight deviation of the pattern bars 10 in the tilting direction is possible and this allows greater production tolerances during manufacture of the selector elements and pattern bars as well as the magnets. This deviation of the pattern bars 10 in the tilting direction is, of course, so slight that it will not cause the control butt 7 of the pusher means 6 to become disengaged from the cam part 8.

Despite the advantages of the inclined surfaces 37, 38, as mentioned, it is also, in principle, possible to use surfaces extending parallel or at right angles to the direction of movement of the selector elements 16.

When the two magnetic poles 35, 36 associated with the selector elements 16 are operative and hold the selector elements 16 in abutment on the surface 38, contrary to the biasing effect of the spring 22, the selector element 16 is lifted to such an extent that the edges 45 pass by the respective control cams 41, 42 and these control cams do not, therefore, become operative. This means that, as explained in the above, the knitting needles 3 can come into the knitting position.

What is claimed is:

1. Knitting machine comprising stitch-forming knitting needles mounted in a rotatingly driven needle cylinder and actuated by pattern bars, the needles being adjustable in accordance with a three-way technique into three operating positions, knitting, floating and tuck positions, electromagnetic selector means comprising two individually controllable magnetic poles for adjusting the knitting needles into respective operating positions, mechanical control means cooperating with the electromagnetic selector means, selector elements displaceably mounted in the pattern bars and biased by springs into an initial position, the mechanical control means urging the selector elements contrary to the pattern bar biasing into a first position triggering the knitting position of the knitting needles, wherein the pattern bars are held in accordance with a pattern by the electromagnetic selector means, a first control cam for bringing the selector element displaced by the electromagnetic selector means and the associated spring into the initial position in accordance with the pattern into a second position triggering the floating position of the knitting needles and for displacing the pattern bars, and a second control cam arranged behind the first in the direction of rotation of the needle cylinder for bringing the selector element displaced by the electromagnetic selector means and the associated spring into the initial position in accordance with the pattern into a third position triggering the tuck position of the knitting needles and for displacing the pattern bar, further comprising only one single spring-biased selector element (16) displaceably mounted in each pattern bar (10) and each of the individually controllable magnetic poles (35, 36) arranged one behind the other in the direction of rotation of the needle cylinder (1).

* * * * *